US007325688B1

(12) United States Patent
Tessmer et al.

(10) Patent No.: US 7,325,688 B1
(45) Date of Patent: Feb. 5, 2008

(54) PRESSURIZED WATER-SOLUBLE POUCH

(75) Inventors: Michael J. Tessmer, Yuma, AZ (US); Robert D. Christiansen, Yuma, AZ (US)

(73) Assignee: Gowan Milling Company, L.L.C., Yuma, AZ (US)

( * ) Notice: Subject to any disclaimer, the term of this patent is extended or adjusted under 35 U.S.C. 154(b) by 454 days.

(21) Appl. No.: 10/671,893

(22) Filed: Sep. 26, 2003

(51) Int. Cl.
*B65D 85/84* (2006.01)
*C11D 17/06* (2006.01)
*C11D 17/04* (2006.01)

(52) U.S. Cl. ..... 206/524.7; 510/220; 510/296; 510/224; 510/277; 510/439; 383/1

(58) Field of Classification Search ..... 206/524.7 X, 206/526, 525; 510/296 X, 352, 439 X, 475, 510/220; 383/111–109, 3
See application file for complete search history.

(56) References Cited

U.S. PATENT DOCUMENTS

| | | | | |
|---|---|---|---|---|
| 2,700,461 | A * | 1/1955 | Smith | 206/5 |
| 3,186,869 | A * | 6/1965 | Friedman | 428/335 |
| 3,591,870 | A * | 7/1971 | Friesen | 4/144.2 |
| 4,189,868 | A * | 2/1980 | Tymchuck et al. | 47/84 |
| 4,340,491 | A | 7/1982 | Lee | |
| 4,434,893 | A * | 3/1984 | Barlow | 206/522 |
| 4,478,044 | A | 10/1984 | Magid | |
| 4,681,228 | A * | 7/1987 | Kerry et al. | 206/484 |
| 4,725,465 | A * | 2/1988 | Lastovich | 428/34.3 |
| 4,765,916 | A * | 8/1988 | Ogar et al. | 510/513 |
| 4,795,032 | A * | 1/1989 | Kandathil | 8/137 |
| 4,844,828 | A | 7/1989 | Aoki | |
| RE33,646 | E | 7/1991 | Klemm et al. | |
| 5,137,154 | A * | 8/1992 | Cohen | 206/522 |
| 5,222,595 | A | 6/1993 | Gouge et al. | |
| 5,287,967 | A | 2/1994 | Backhouse et al. | |
| 5,403,096 | A | 4/1995 | Aagesen | |
| 5,523,275 | A | 6/1996 | Lisa et al. | |
| 5,558,228 | A * | 9/1996 | Jackisch et al. | 206/524.7 |
| 6,451,590 | B1 * | 9/2002 | Adelberg et al. | 435/292.1 |
| 2002/0169092 | A1 * | 11/2002 | Alexandre Catlin et al. | 510/220 |
| 2003/0069155 | A1 | 4/2003 | Mangin et al. | |
| 2003/0100463 | A1 | 5/2003 | Delamarche et al. | |

FOREIGN PATENT DOCUMENTS

| | | |
|---|---|---|
| EP | 0 314 890 A2 | 5/1989 |
| EP | 1 256 623 A1 | 11/2002 |
| EP | 1 314 653 A1 | 5/2003 |
| WO | WO 03/045813 A1 | 6/2003 |
| WO | WO 02/090486 A1 | 11/2003 |

* cited by examiner

*Primary Examiner*—Jila M Mohandesi
(74) *Attorney, Agent, or Firm*—Quarles & Brady LLP

(57) ABSTRACT

A pressurized pouch is made of a water-soluble material, preferably PVA film, to hold a concentrated product for later mixing in a bottle to provide a water solution. Because of the interior pressure, the water-soluble pouch retains a semi-rigid resilient shape that greatly facilitates its introduction through the neck of the bottle. The pressurized pouch can be made by either VFFS or HFFS machines wherein a puff of air is added prior to sealing. Alternatively, the pouch is made by filling it in a pressurized chamber.

5 Claims, 1 Drawing Sheet

PRESSURIZED WATER-SOLUBLE POUCH

BACKGROUND OF INVENTION

1. Field of Invention

The invention relates to water-soluble pouches and more specifically to methods for packing chemical compositions in water-soluble pouches.

2. Description of Related Art

Water-soluble pouches are economical, easy to handle, and safe to use. Thus, they are becoming of interest for packaging and delivering liquid concentrates and powders. They provide many advantages for both the supplier and end-user and can be used with many different types of products, such as detergents, cleaners, degreasers, deodorizers, and pesticides. These pouches can also be used with hazardous materials to limit exposure of workers to toxins.

The preferred material used to make water-soluble pouches is polyvinyl alcohol (PVA) film. PVA is generally partially or fully alcoholyzed or hydrolyzed (e.g., 40-100%, preferably 80-99% alcoholyzed or hydrolyzed) and comes in many different varieties including biodegradable and edible films, cold and hot water-soluble films, and a number of different formulations to ensure compatibility with different products. Some examples of different PVA water-soluble pouches are described in several U.S. patents and applications, including U.S. Pat. No. 4,844,828, U.S. Pat. No. 4,340,491, U.S. Pat. No. 5,222,595, and U.S. Patent Publication 2003/0100463. Other suitable materials include polyethylene oxide, such as polyethylene glycol; starch and modified starch; alkyl and hydroxyalkylcellulose, such as hydroxymethylcellulose, hydroxyethylcellulose, hydroxypropyl cellulose; carboxymethylcellulose; polyvinylethers such as poly methyl vinylether or poly(2-methoxyethoxyethylene); poly(2,4-dimethyl-6-triazinylethylene; poly(3-morpholinyl ethylene); poly(N-1,2,4-triazolylethylene); poly(vinylsulfonic acid); polyanhydrides; low molecular weight melamine-formaldehyde resins; low molecular weight urea-formaldehyde resins; poly(2-hydroxyethyl methacrylate); polyacrylic acid and its homologs. Polyvinyl acetate (or other ester) film, copolymers or other derivatives of such polymers can also be used.

There are two popular methods of packaging items in water-soluble pouches: vertical form/fill/seal (VFFS) and horizontal form/fill/seal (HFFS). In the VFFS process, a packaging machine transports the PVA film vertically downward and forms a tube. Next, the machine fills the tube with the desired product and the tube is sealed. Accordingly, the VFFS process is the preferred method for packaging items in a liquid, powder, paste or granular state. The HFFS process operates similarly. A packaging machine transports the PVA film in a horizontal direction and then forms a pouch. The machine fills the pouch with the desired product and seals it. Consequently, this process is widely used for packaging solid items. The two processes enable water-soluble pouches to be used for a variety of applications.

The use of water-soluble pouches provides a number of benefits. One is the reduced shipping cost of products. Because the pouch contents are in a concentrate or powder form, suppliers do not have to ship a solution containing a large amount of water, thus reducing shipping weight. In addition, the size of packaging is decreased, thereby reducing shipping costs even more. Likewise, the reduced package size minimizes storage costs for both the supplier and end-user.

Furthermore, water-soluble pouches are convenient and safe for everyone involved in the transport and use of chemical compounds. The pouches are suitable for hazardous solutions such as pesticides or herbicides. Therefore, workers and end-users are not exposed to hazardous materials or dust while handling the compositions or mixing them into the final solution. In addition, because these pouches contain a pre-measured amount of concentrate or powder, the end-user mixes the entire pouch in a specified amount of water to make a desired amount of solution. Thus, no product loss or exposure is involved in the process of dissolving the contents into a functional container such as a spray bottle or canister.

Despite the benefits of water-soluble pouches, there are some disadvantages. Because it is convenient for the pouches to dissolve in water rapidly, the PVA material is used in thin films which are necessarily flexible and flimsy. Therefore, it is difficult to insert the pouches in containers with small openings through which they need to be manipulated. This can cause the pouch to burst spilling the contents, possibly exposing the user to dangerous chemicals.

Therefore, there is a need to improve water-soluble pouches to limit the flexibility of the package so as to facilitate the process of introducing the pouches through bottle necks and reducing the risk of the pouch rupturing.

SUMMARY OF INVENTION

One objective of the invention is to provide a water-soluble pouch that maintains a consistent shape in spite of its thin-walled structure.

As a result, an additional objective of the invention is a water-soluble pouch that can be fitted more easily than currently available pouches into containers with a small opening, such as the neck of a bottle.

Another objective of the invention is to provide a water-soluble pouch that is less susceptible to rupture during insertion into containers as a result of the reduced manipulation required in the process.

Accordingly, the invention relates to a water-soluble pouch that maintains a consistent shape as a result of pressurization, and to a process for making the same. The pressurized pouch is easier to handle because of its acquired rigidity which facilities its manipulation through openings of substantially equal size and shape. Such a pressurized pouch is also less susceptible to rupturing because it is less likely to be pinched during handling. In addition, the pressure prevents creasing during storage and shipping, which could lead to crystallization of the film and to the formation of pinholes or to weakening and eventual rupturing of the pouch. Pressurized pouches are also more appealing at the point of purchase. Finally, because the shape of the pouch is materially changed upon depressurization, leakage can easily be identified by visual inspection.

The pressurization of the pouch can be accomplished in a number of ways. One method includes puffing air (or another gas, such as nitrogen) into the pouch while it is being filled and then immediately sealing it. The burst of air trapped inside, which may be pulsed or blown continuously from a pressurized source, is sufficient to pressurize the pouch as necessary to practice the invention. Another method of pressurization is by filling the pouch in a pressurized chamber. Thus, the pouch is pressurized relative to the environment outside the chamber. Yet another method is by injecting a pressurizing gas into the pouch using a needle after the pouch is formed, filled and sealed.

DETAILED DESCRIPTION

The invention relates to a pressurized water-soluble pouch and a process of making the same. The term pouch is used herein to include all types of water-soluble containers, such as pouches, sachets, bags and packets. For the purposes of the invention, a pressurized pouch is defined as one where a sufficient interior pressure is maintained to cause the exterior of the pouch to remain extended at ambient pressures. The term resilient is used to refer to a semi-rigid condition whereby the pouch of the invention tends to recover its shape when subjected to an external force. The degree of pressurization may vary for different size pouches and for different uses.

Additionally, it is understood that the invention relates to pouches of any shape or size depending on the packaged product and its uses. For example, a concentrate used to make a large volume of solution would require a larger pouch than needed to prepare a mixture in a conventional spray bottle. Similarly, a concentrate that is intended to be passed through a small bottle opening requires a long tube-like sachet, while a concentrate that is dropped into the opening of a barrel may be packaged in any conforming shape. It is also understood that the pressurized water-soluble pouch can be used with a variety of products including detergents, cleansers, pesticides, and deodorizers in both liquid and powder form.

Figure 1:
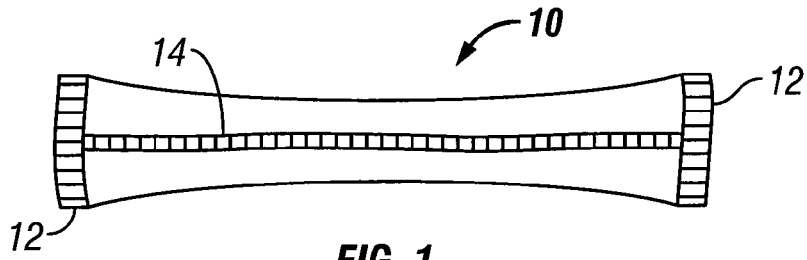
FIG. 1 is a top view of a prior art water-soluble pouch created by a VFFS machine.

FIG. 1 illustrates a prior-art water-soluble pouch 10 made of PVA film using a VFFS packaging machine. The pouch 10 has seals 12 on each end and contains a product intended to be mixed in a liquid before use. A seam 14 is also created along the length of the tube when the pouch is formed during the VFFS process. The pouch 10 shown in FIG. 1 is representative of a sachet, but, as stated before, water-soluble pouches can take a variety of sizes and shapes and contain a number of products. Because it is non-pressurized, the pouch 10 retains the flexibility of the PVA film and its shape is affected only by the amount and nature of the contents. For example, a packaged powder would be more flexible than a packaged liquid concentrate. In addition, it is impractical to remove all air from the pouch during a conventional packaging process. Therefore, the amount of air left in the package also affects its flexibility. If enough unpressurized air is left in the package, it may easily fold in half when it is held by a user. Consequently, if the pouch is to be inserted into a small opening such as the neck of a spray bottle, the pouch may fold over the opening and make it difficult to complete its introduction into the container. Furthermore, the pouch may be pinched and ruptured.

Figure 2:
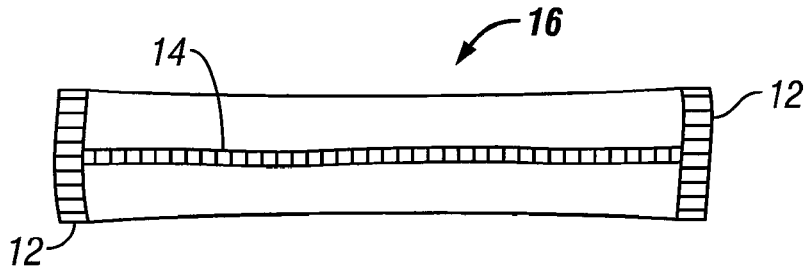
FIG. 2 is a top view of a pressurized water-soluble pouch created by a VFFS machine.

FIG. 2 displays a pressurized water-soluble pouch 16 according to the preferred embodiment of the invention. The water-soluble pouch 16 includes sealed ends 12 and a seam 14 lengthwise as a conventional pouch. The pouch 16 may be formed in a VFFS packing machine, or in an HFFS machine or by any other water-soluble packing process. The sealed ends 12 and the seam 14 provide a means to hold pressure n the water-soluble pouch 16. Due to the interior pressure, the pouch 16 stretches to take a shape conforming to the geometry of the PVA structure. The resulting pressurized pouch is harder to flex and pinch in spite of the flexibility of its walls.

Thus, one advantage of a pressurized pouch is that shape is readily maintained regardless of the degree to which the pouch is filled with product. Furthermore, so long as the additional pressure in the pouch is provided using a gas that does not affect the properties of the water-soluble film or the composition inside the pouch, it can be used for any conventional application. It has been found that PVA pouches pressurized to about 1-2 psig are suitable to maintain a consistent shape in a typical atmospheric environment. At this pressure level, the pouches become semi-rigid and can be manipulated through an opening with ease, but retain sufficient flexibility to conform to pressure without stretching the film too thin, which could cause the pouch to rupture.

The pressurized water-soluble pouch of the invention has the same construction as a non-pressurized pouch. Like the prior-art pouch, the pressurized pouch can be made of various water-soluble material, but preferably PVA film. An example of a suitable PVA film is the PVAL water-soluble film sold by Aicello Chemical Company of Japan under the trademark SOLUBLON. The pouch can be made using both VFFS and HFFS machinery and can be used in the same manner as non-pressurized pouches.

Figure 3:
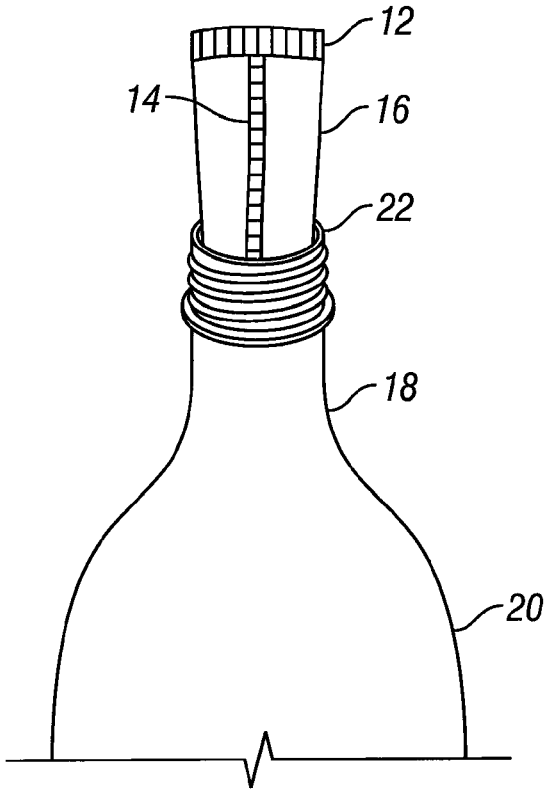
FIG. 3 is an elevational view of a pressurized water-soluble pouch inside the neck of a rigid container.

FIG. 3 illustrates the pressurized water-soluble pouch 16 partially inserted inside the neck 18 of a rigid container 20. One advantage of the pressurized pouch in comparison to an unpressurized one is that it can be passed through an opening of a container without any significant resistance as a result of the increased rigidity in the packaging. As shown in FIG. 3, the opening 22 of the container 20 has a diameter approximately equal to that of the pouch 16, but the pouch can be introduced relatively easily simply by pushing it through. Because of the semi-rigid resilient condition produced by pressurization, the pouch 16 is much less likely to deform and fold over the neck 18 under downward pressure, as would be the case with an unpressurized pouch.

Thus, for example, in order to prepare a solution of hard-surface cleaner for use in a standard spray bottle container, a manufacturer would package a concentrate for shipment to retail stores where an end user would purchase it. Then the user would mix it with a predetermined amount of water in a dedicated container simply by introducing it through the opening of the container. Unlike a non-pressurized pouch, the pouch of the invention would not bend or catch the side of the opening, thereby advantageously facilitating the mixing process.

In the preferred method of manufacture, the pressurized water-soluble pouch is produced by puffing a quick burst of air (or other gas, such as nitrogen) inside a filled water-soluble pouch and then immediately sealing the pouch. Using a VFFS machine, a tube of PVA film is created, the tube is filled, and a puff of air is added as the pouch is being sealed. The air so trapped inside has been found to be sufficient to pressurize the pouch to about 1-2 psig. This process could be similarly implemented in an HFFS packaging machine also.

As mentioned above, the water-soluble pouch of the invention could also be produced by filling the pouches in a pressurized environment to relative to ambient. Thus, after the packing machine fills and seals the water-soluble pouches, they are automatically pressurized when exposed to normal ambient pressure. Obviously, the pouch could also be pressurized according to the invention in a totally separate process by inserting a needle through the water-soluble film and pressurizing the pouch after it has been filled with product and sealed, and then by sealing the opening created by the removal of the needle to ensure the pressure is retained.

Various changes in the details, steps and components that have been described may be made by those of ordinary skill in the art within the principles and scope of the invention herein illustrated and defined in the appended claims. For example, the pouch of the invention has been described as a water-soluble sachet containing a product intended to ultimate dissolution in water, but the invention could be practiced in equivalent fashion to carry a product intended for dissolution in another liquid. In such a case, the pouch would be made with a material that is soluble in that liquid.

Therefore, while the present invention has been shown and described herein in what is believed to be the most practical and preferred embodiments, it is recognized that departures can be made therefrom within the scope of the invention, which is not to be limited to the details disclosed herein but is to be accorded to the full scope of the claims so as to embrace any and all equivalent apparatus and processes.

We claim:

1. A container for a product intended for dissolution in a liquid, comprising:

a sealed pouch made of a material that is soluble in said liquid;

a product contained in the pouch; and a gas contained in the pouch in sufficient quantity to cause the pouch to be resilient at ambient conditions, wherein said gas is pressurized to at least 1-2 psig.

2. The container of claim 1, wherein the liquid is water, the material is water soluble and the gas is air.

3. The container of claim 2, wherein the pouch is made of polyvinyl alcohol.

4. The container of claim 2, wherein the product is a powder.

5. The container of claim 2, wherein the product is a liquid.

* * * * *